US009974140B2

(12) United States Patent
Seki

(10) Patent No.: US 9,974,140 B2
(45) Date of Patent: May 15, 2018

(54) LIGHT-EMITTING DEVICE AND LUMINAIRE

(71) Applicant: Panasonic Intellectual Property Management Co., Ltd., Osaka (JP)

(72) Inventor: Keisuke Seki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days. days.

(21) Appl. No.: 15/371,704

(22) Filed: Dec. 7, 2016

(65) Prior Publication Data

US 2017/0171936 A1 Jun. 15, 2017

(30) Foreign Application Priority Data

Dec. 10, 2015 (JP) ..... 2015-241593

(51) Int. Cl.

| | |
|---|---|
| ***H05B 37/02*** | (2006.01) |
| ***H05B 33/08*** | (2006.01) |
| *F21Y 115/10* | (2016.01) |
| *F21V 23/00* | (2015.01) |
| *F21S 8/02* | (2006.01) |

(52) U.S. Cl.

CPC ..... *H05B 33/0866* (2013.01); *H05B 33/0827* (2013.01); *F21S 8/02* (2013.01); *F21V 23/009* (2013.01); *F21Y 2115/10* (2016.08)

(58) Field of Classification Search

CPC .. H05B 37/20; H05B 33/083; H05B 33/0857; H05B 33/0827; H05B 33/0866; F21Y 2115/10; F21V 23/009; F21S 8/02

USPC ..... 315/192

See application file for complete search history.

(56) References Cited

U.S. PATENT DOCUMENTS 8,067,989 B1 * 11/2011 Groe ..... H03L 7/0995 327/156
9,549,447 B2 * 1/2017 Peeters ..... H05B 33/0827

(Continued)

FOREIGN PATENT DOCUMENTS

JP 2007-059260 3/2007
JP 2011-198821 10/2011

(Continued)

*Primary Examiner* — Don Le

(74) *Attorney, Agent, or Firm* — Renner, Otto, Boisselle & Sklar, LLP

(57) ABSTRACT

A light-emitting device includes: a first light-emitting element array including one of a single first light-emitting element or a plurality of first light-emitting elements connected in series, and having a first emission color; a second light-emitting element array including one of a single second light-emitting element or a plurality of second light-emitting elements connected in series, and having a second emission color different from the first emission color, the second light-emitting element array being connected to the first light-emitting element array in parallel; and a third light-emitting element array including one of a single third light-emitting element or a plurality of third light-emitting elements connected in series, and having a third emission color different from the first emission color and the second emission color, the third light-emitting element array being connected to the first light-emitting element array and the second light-emitting element array in series.

15 Claims, 13 Drawing Sheets

(56) References Cited

U.S. PATENT DOCUMENTS

2006/0232219 A1* 10/2006 Xu ..... H05B 33/0809 315/209 R
2011/0210675 A1 9/2011 Hamamoto et al.
2012/0200229 A1* 8/2012 Kunst ..... H05B 33/0815 315/186
2013/0063035 A1* 3/2013 Baddela ..... H05B 33/086 315/192
2013/0147380 A1* 6/2013 Chobot ..... H05B 33/083 315/210
2014/0111091 A1* 4/2014 Grajcar ..... H05B 33/0809 315/122
2014/0210352 A1* 7/2014 Grajcar ..... H05B 33/083 315/122
2014/0210357 A1* 7/2014 Yan ..... H05B 33/0824 315/186
2014/0210361 A1* 7/2014 Ferrier ..... H05B 33/0812 315/186
2014/0361711 A1* 12/2014 Takahashi ..... H05B 33/0812 315/294
2015/0077000 A1 3/2015 Takahashi et al.
2015/0097489 A1* 4/2015 Wu ..... H05B 33/0827 315/122
2015/0137689 A1* 5/2015 Hu ..... H05B 33/0824 315/192
2015/0195874 A1* 7/2015 Kang ..... H05B 33/083 315/192
2016/0043279 A1* 2/2016 Jean ..... H01L 33/325 257/13
2016/0205741 A1 7/2016 Seki et al.
2016/0205742 A1* 7/2016 Seki ..... H05B 33/0827 315/122

FOREIGN PATENT DOCUMENTS

JP 2013-191522 9/2013
JP 2014-086271 5/2014
JP 2014-146595 8/2014
JP 2015-056381 3/2015
JP 2015-156264 8/2015
JP 2016-129126 7/2016
WO WO 2013/118208 A1 8/2013

* cited by examiner

LIGHT-EMITTING DEVICE AND LUMINAIRE

CROSS REFERENCE TO RELATED APPLICATION

This application claims the benefit of priority of Japanese Patent Application Number 2015-241593 filed on Dec. 10, 2015, the entire content of which is hereby incorporated by reference.

BACKGROUND

1. Technical Field

The present disclosure relates to a light-emitting device including a plurality of light-emitting element arrays which are different from one another in emission color, and a luminaire using the light-emitting device.

2. Description of the Related Art

Conventionally, luminaires which can change color temperature, that is, luminaires which can perform color toning are known (for example, see Patent Literature 1 (PTL 1): Japanese Unexamined Patent Application Publication No. 2015-56381).

A light source of the luminaire disclosed in PTL 1 includes a first light-emitting unit having a plurality of first light-emitting elements and a second light-emitting unit having a plurality of second light-emitting elements and having an emission color different from an emission color of the first light-emitting unit. The luminaire disclosed in PTL 1 can change the emission color, that is, perform dimming, by controlling a current flowing through the first light-emitting unit and the second light-emitting unit.

SUMMARY

The luminaire disclosed in PTL 1, however, includes two light-emitting units having mutually different emission colors to change the emission color. For this reason, in order for the luminaire disclosed in PTL 1 to emit light of an illumination intensity equivalent to that of a luminaire with no dimming function, it is necessary to include about twice as many light-emitting elements as the luminaire with no dimming function. This causes the luminaire disclosed in PTL 1 to be larger in size and cost than the luminaire with no dimming function.

In view of this, the present disclosure has an object to provide a light-emitting device and a luminaire which can perform color toning while reducing the number of light-emitting elements to be used.

In order to achieve the above object, a light-emitting device according to an aspect of the present disclosure includes: a first light-emitting element array including one of a single first light-emitting element or a plurality of first light-emitting elements connected in series, and having a first emission color; a second light-emitting element array including one of a single second light-emitting element or a plurality of second light-emitting elements connected in series, and having a second emission color different from the first emission color, the second light-emitting element array being connected to the first light-emitting element array in parallel; and a third light-emitting element array including one of a single third light-emitting element or a plurality of third light-emitting elements connected in series, and having a third emission color different from the first emission color and the second emission color, the third light-emitting element array being connected to the first light-emitting element array and the second light-emitting element array in series.

The present disclosure makes it possible to provide a light-emitting device and a luminaire which can perform color toning while reducing the number of light-emitting elements to be used.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF EMBODIMENTS

Hereinafter, embodiments of the present disclosure will be described in detail with accompanying drawings. It should be noted that each of the embodiments described below is to illustrate a specific example of the present disclosure. Therefore, the numerical values, shapes, materials, structural elements, the arrangement and connection of the structural elements, etc., illustrated in the following embodiments are mere examples, and are therefore not intended to limit the present disclosure. Thus, among the structural elements in the following embodiments, structural elements not recited in any one of the independent claims representing the most generic concepts of the present disclosure are described as optional structural elements.

It should also be noted that each figure is a schematic diagram and not necessarily a precise illustration. Furthermore, in the figures, the same structural elements are given the same reference signs.

Embodiment 1

Hereinafter, a light-emitting device and a luminaire including the light-emitting device according to Embodiment 1 will be described.

[1-1. Luminaire Configuration]

First, the configuration of the luminaire according to the present embodiment will be described with reference to the drawings.

Figure 1:
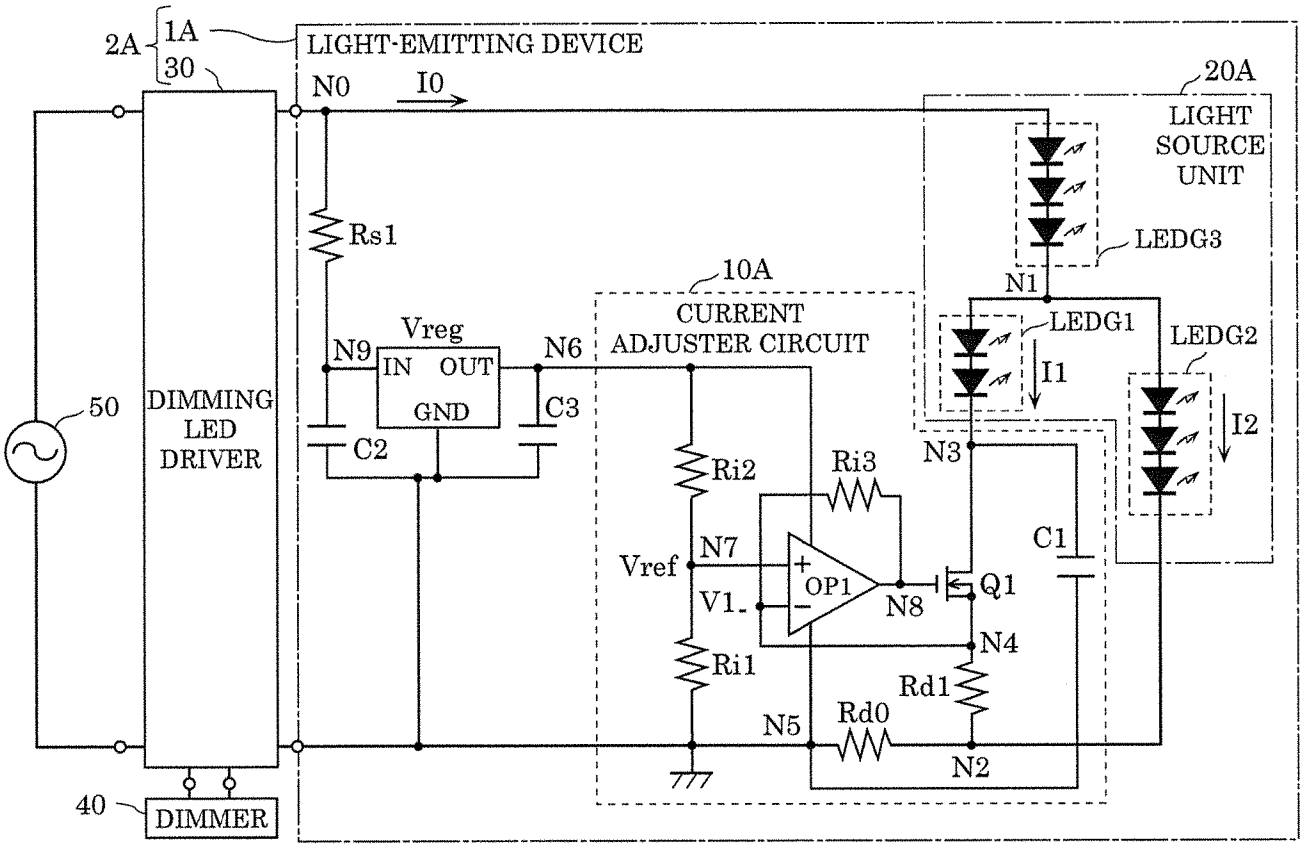
FIG. 1 is a circuit diagram illustrating an example of the circuit configuration of a luminaire according to Embodiment 1.

FIG. 1 is a circuit diagram illustrating an example of the circuit configuration of luminaire 2A according to the present embodiment.

Luminaire 2A has dimming and color toning functions and includes dimming LED driver 30 and light-emitting device 1A as illustrated in FIG. 1. Luminaire 2A is supplied with AC power from AC power supply 50. The dimming level of luminaire 2A is determined by dimmer 40.

AC power supply 50 is, for example, a grid power supply such as an external, commercial power supply.

Dimmer 40 is a device which sets a dimming level of the luminaire. In the present embodiment, dimmer 40 outputs a dimming signal indicating a dimming level to dimming LED driver 30.

Dimming LED driver 30 is a constant current supply which supplies light-emitting device 1A with constant current I0. In the present embodiment, dimming LED driver 30 supplies light-emitting device 1A with constant current I0 corresponding to the dimming signal received from dimmer 40. Dimming LED driver 30 includes a dimming circuit for achieving a dimming level corresponding to the dimming signal. A phase dimming circuit can be used as the dimming circuit, for example. The dimming circuit adjusts the range of phase (ON phase) of AC voltage. It should be noted that a pulse width modulation (PWM) dimming circuit may be used as the dimming circuit. Dimming LED driver 30 further includes an AC/DC converter, a booster or step-down circuit, and a smoothing circuit (not illustrated), and converts the AC voltage output from the dimming circuit into a DC voltage and supplies light source unit 20A with constant current I0 (DC current) of a magnitude corresponding to the DC voltage resulting from the conversion. Details of such dimming LED driver 30 are well known to a person with an ordinary skill in the art, and are thus omitted here.

[1-1-1. Light-Emitting Device Configuration]

Light-emitting device 1A includes a plurality of light sources (light-emitting element arrays) which are different from one another in emission color. In the present embodiment, light-emitting device 1A tones the color of light to be emitted, according to a change in one parameter, i.e., the magnitude of constant current I0 output from dimming LED driver 30. That is to say, light-emitting device 1A performs color toning according to the dimming level. Light-emitting device 1A distributes constant current I0 among the plurality of light-emitting element arrays, and performs color toning by adjusting the brightness of each light-emitting element array by changing the ratio of currents flowing through light-emitting element arrays having different emission colors.

As illustrated in FIG. 1, light-emitting device 1A mainly includes light source unit 20A, three-terminal regulator Vreg, a first detector circuit (resistance element Rd1), a constant current detector circuit (resistance element Rd0), and current adjuster circuit 10A. In the present embodiment, light source unit 20A, three-terminal regulator Vreg, and current adjuster circuit 10A are mounted on the same base. This allows light-emitting device 1A to be integrally formed and allows the structural elements to be electrically connected to one another.

Hereinafter, each structural element of light-emitting device 1A will be described.

[Light Source Unit]

Light source unit 20A includes first light-emitting element array LEDG1, second light-emitting element array LEDG2 connected to first light-emitting element array LEDG1 in parallel, and third light-emitting element array LEDG3 connected to first light-emitting element array LEDG1 and second light-emitting element array LEDG2 in series. Light source unit 20A is supplied with constant current I0 from dimming LED driver 30, which is a constant current supply.

First light-emitting element array LEDG1 is a light-emitting element array (light-emitting module) including one of a single first light-emitting element or a plurality of first light-emitting elements connected in series, and having a first emission color. In the present embodiment, first light-emitting element array LEDG1 includes two LEDs of the same type which are connected in series. Here, LEDs of "the same type" refer to LEDs having forward voltages of the same magnitude. The two LEDs are examples of first light-emitting elements. The two LEDs included in first light-emitting element array LEDG1 are LEDs whose first emission color has a color temperature of 1500 K. It should be noted that although the two LEDs included in first light-emitting element array LEDG1 may be of any type as long as they have the same color temperature, cost reduction is possible by using LEDs of "the same type" in the sense mentioned above.

The LEDs included in first light-emitting element array LEDG1 may each emit light at a color temperature of 1500 K, or the light emitted by the LEDs may be converted into light having a color temperature of 1500 K using a phosphor, for example.

In the following description, the cathode terminal of the leading LED of first light-emitting element array LEDG1 in the direction of current flow is referred to as the cathode terminal of first light-emitting element array LEDG1, and the anode terminal of the second LED of first light-emitting element array LEDG1 in the direction of current flow is referred to as the anode terminal of first light-emitting element array LEDG2. The anode terminal and the cathode terminal of first light-emitting element array LEDG1 are connected to node N1 and node N3, respectively. A current flowing through first light-emitting element array LEDG1 is referred to as current I1.

Second light-emitting element array LEDG2 is a light-emitting element array (light-emitting module) including one of a single second light-emitting element or a plurality of second light-emitting elements connected in series, and having a second emission color different from the first emission color. Second light-emitting element array LEDG2 is connected to first light-emitting element array LEDG1 in parallel. In the present embodiment, second light-emitting element array LEDG2 includes three LEDs of the same type which are connected in series. Here, LEDs of "the same type" refer to LEDs having forward voltages of the same magnitude. The three LEDs are examples of second light-emitting elements. The three LEDs included in second light-emitting element array LEDG2 are LEDs whose second emission color has a color temperature of 6500 K. It should be noted that the forward voltages of the LEDs included in second light-emitting element array LEDG2 are all the same, and here, the same as the forward voltages of the LEDs included in first light-emitting element array LEDG1. It should also be noted that although the three LEDs included in second light-emitting element array LEDG2 may be of any type as long as they have the same color temperature, cost reduction is possible by using LEDs of "the same type" in the sense mentioned above.

The LEDs included in second light-emitting element array LEDG2 may each emit light at a color temperature of 6500 K, or the light emitted by the LEDs may be converted into light having a color temperature of 6500 K using a phosphor, for example.

In the following description, the cathode terminal of the leading LED of second light-emitting element array LEDG2 in the direction of current flow is referred to as the cathode terminal of second light-emitting element array LEDG2, and the anode terminal of the third LED of second light-emitting element array LEDG2 in the direction of current flow is referred to as the anode terminal of second light-emitting element array LEDG2. The anode terminal and the cathode terminal of second light-emitting element array LEDG2 are connected to node N1 and node N2, respectively. A current flowing through second light-emitting element array LEDG2 is referred to as current I2.

In the present embodiment, the number of LEDs included in first light-emitting element array LEDG1 is less than the number of LEDs included in second light-emitting element array LEDG2. That is to say, the sum of the forward voltages of the single or plurality of LEDs that belong to second light-emitting element array LEDG2 is greater than the sum of the forward voltages of the single or plurality of LEDs that belong to first light-emitting element array LEDG1. For this reason, a current flows through first light-emitting element array LEDG1 but not through second light-emitting element array LEDG2 when the voltage difference between node N1 and node N2 is greater than the sum of the forward voltages of first light-emitting element array LEDG1 and less than the sum of the forward voltages of second light-emitting element array LEDG2. In other words, in the present embodiment, dimming is possible in such a manner that first light-emitting element array LEDG1 is turned on and second light-emitting element array LEDG2 is turned off.

Third light-emitting element array LEDG3 is a light-emitting element array including one of a single third light-emitting element or a plurality of third light-emitting elements connected in series, and having a third emission color different from the first emission color and the second emission color. Third light-emitting element array LEDG3 is connected to first light-emitting element array LEDG1 and second light-emitting element array LEDG2 in series. In the present embodiment, third light-emitting element array LEDG3 includes three LEDs of the same type which are connected in series. Here, LEDs of "the same type" refer to LEDs having forward voltages of the same magnitude. The three LEDs are examples of third light-emitting elements.

The three LEDs included in third light-emitting element array LEDG3 are LEDs whose third emission color has a color temperature of 3500 K. That is to say, the color temperature of the first emission color (1500 K) is lower than the color temperature of the third emission color (3500 K), and the color temperature of the second emission color (6500 K) is higher than the color temperature of the third emission color. Since the light-emitting element arrays of light source unit 20A according to the present embodiment have such emission colors, light-emitting device 1A can perform color toning within a range of color temperatures from 2700 K to 5000 K. The color toning performed by light-emitting device 1A will be described later.

In the following description, the cathode terminal of the leading LED of third light-emitting element array LEDG3 in the direction of current flow is referred to as the cathode terminal of third light-emitting element array LEDG3, and the anode terminal of the third LED of third light-emitting element array LEDG3 in the direction of current flow is referred to as the anode terminal of third light-emitting element array LEDG3. The anode terminal and the cathode terminal of third light-emitting element array LEDG3 are connected to node N0 and node N1, respectively. A current flowing through third light-emitting element array LEDG3 is equal to constant current I0.

As described above, light source unit 20A according to the present embodiment includes first light-emitting element array LEDG1 including two LEDs, second light-emitting element array LEDG2 including three LEDs, and third light-emitting element array LEDG3 including three LEDs. That is to say, light source unit 20A includes eight LEDs in total.

[Three-Terminal Regulator]

Three-terminal regulator Vreg is a conventional circuit that generates a constant voltage and has input terminal IN connected to node N9 and output terminal OUT connected to node N6. Capacitor C2 is connected between input terminal IN and ground terminal GND. Capacitor C3 is connected between output terminal OUT and ground terminal GND.

Input terminal IN is connected to a high potential-side output terminal (node N0) of dimming LED driver 30 via resistance element Rs1. Resistance element Rs1 disposed between node N0 and input terminal IN is an element for adjusting the magnitude of a voltage to be applied to input terminal IN to an appropriate magnitude.

[First Detector Circuit]

The first detector circuit is connected to first light-emitting element array LEDG1 in series and detects the magnitude of current I1 flowing through first light-emitting element array LEDG1. The first detector circuit in the present embodiment is resistance element Rd1 having one end connected to node N4 and the other end connected to node N2.

Node N4 is connected with the source terminal of transistor Q1 included in current adjuster circuit 10A and the negative-side input terminal of operational amplifier OP1 included in current adjuster circuit 10A.

This means that a voltage obtained by adding a voltage equivalent to a voltage drop across resistance element Rd1 to the voltage at node N2 is applied to the negative-side input terminal of operational amplifier OP1. Assuming the resistance value of resistance element Rd1 to be R1, the voltage equivalent to the voltage drop across resistance element Rd1 is represented as R1×I1, and thus the voltage applied to the negative-side input terminal of operational amplifier OP1 is dependent on the magnitude of current I1 flowing through first light-emitting element array LEDG1. Connecting resistance element Rd1 to first light-emitting element array LEDG1 in series enables detection of the magnitude of current I1.

[Constant Current Detector Circuit]

The constant current detector circuit detects the magnitude of constant current I0. The constant current detector circuit in the present embodiment is resistance element Rd0 having one end connected to node N2 and the other end connected to a low voltage-side terminal (node N5) of dimming LED driver 30.

Assuming the resistance value of resistance element Rd0 to be R0, the voltage at node N2 is a sum of a voltage at the low voltage-side terminal (node N5) of dimming LED driver 30 and a voltage equivalent to a voltage drop across resistance element Rd0 (R0×I0). In the present embodiment, a voltage applied to the negative-side input terminal of operational amplifier OP1 is a sum of the voltage equivalent to the voltage drop across resistance element Rd0 and the voltage equivalent to the voltage drop across resistance element Rd1, which is the first detector circuit. Providing resistance element Rd0 enables detection of constant current I0.

[Current Adjuster Circuit]

Current adjuster circuit 10A adjusts the current flowing through first light-emitting element array LEDG1. In the present embodiment, current adjuster circuit 10A adjusts a relationship of the magnitude of the current flowing through first light-emitting element array LEDG1 to the magnitude of constant current I0 based on the magnitude of the current as detected by the first detector circuit. To be more specific, current adjuster circuit 10A changes the relationship of the magnitude of the current flowing through first light-emitting element array LEDG1 to the magnitude of constant current I0 by comparing the magnitude of the current as detected by the first detector circuit with a reference value. It should be noted that current adjuster circuit 10A according to the present embodiment adjusts the magnitude of the current flowing through first light-emitting element array LEDG1 according to, in addition to the magnitude of the current flowing through first light-emitting element array LEDG1, the magnitude of constant current I0 detected by the constant current detector circuit.

As illustrated in FIG. 1, current adjuster circuit 10A includes a voltage divider circuit, transistor Q1, a comparison amplifier circuit, and capacitor C1.

The voltage divider circuit generates reference voltage Vref from the constant voltage output from three-terminal regulator Vreg, and outputs the voltage obtained by dividing the constant voltage to the positive-side input terminal of operational amplifier OP1 illustrated in FIG. 1. The voltage divider circuit is a series circuit including resistance element Ri1 and resistance element Ri2, and has, as the output node, node N7 which is a connection node between resistance element Ri1 and resistance element Ri2. Resistance element Ri1 has one end connected to node N5 and the other end connected to node N7. Resistance element R12 has one end connected to node N6 (the node to which output terminal OUT of three-terminal regulator Vreg is connected) and the other end connected to node N7.

Assuming the resistance value of resistance element Ri1 to be R11 and the resistance value of resistance element Ri2 to be R12, reference voltage Vref can be obtained by (the output voltage of three-terminal regulator Vreg)×R11/(R11+R12).

Transistor Q1 adjusts the current flowing through first light-emitting element array LEDG1. Transistor Q1 is a metal-oxide-semiconductor (MOS) field-effect transistor (FET), and has a gate terminal connected to node N8, a drain terminal connected to the cathode terminal (node N3) of first light-emitting element array LEDG1, and a source terminal connected to the negative-side input terminal of operational amplifier OP1 and one end (node N4) of resistance element Rd1. In other words, first light-emitting element array LEDG1, the drain and source terminals of transistor Q1, and resistance element Rd1, which is the first detector circuit, are connected in series between node N1 and node N2.

The comparison amplifier circuit compares the voltage drop across resistance element Rd1 and the voltage drop across resistance element Rd0 with a reference value, and applies a voltage corresponding to the comparison result to a control terminal (that is, the gate terminal) of transistor Q1. The comparison amplifier circuit here is operational amplifier OP1 having a positive-side input terminal connected to the output node (node N7) of the voltage divider circuit, a negative-side input terminal connected to node N4 which is the output node of the first detector circuit, and an output terminal connected to the gate terminal (node N8) of transistor Q1. Resistance element Ri3 is connected between the negative-side input terminal and the output terminal of operational amplifier OP1.

Applied to the negative-side input terminal of operational amplifier OP1 is voltage V1_ which is a sum of the ground potential of dimming LED driver 30, the voltage drop across resistance element Rd0 (R0×I0), and the voltage drop across resistance element Rd1 (R1×I1). Operational amplifier OP1 compares the voltage drop across resistance element Rd1 (R1×I1) and the voltage drop across resistance element Rd0 (R0×I1) with reference voltage Vref (=reference value). Operational amplifier OP1 outputs a high-level signal of a magnitude corresponding to a difference between the voltage applied to the negative-side input terminal and reference voltage Vref when the voltage applied to the negative-side input terminal is less than reference voltage Vref. Operational amplifier OP1 outputs a low-level signal when the voltage applied to the negative-side input terminal is greater than reference voltage Vref.

Capacitor C1 is an element for reducing a rapid change in and oscillations of the current flowing through first light-emitting element array LEDG1. Capacitor C1 is connected between node N3 and node N5.

[1-2. Operation]

Hereinafter, an operation of current adjuster circuit 10A will be described with reference to the drawings.

Figure 2:
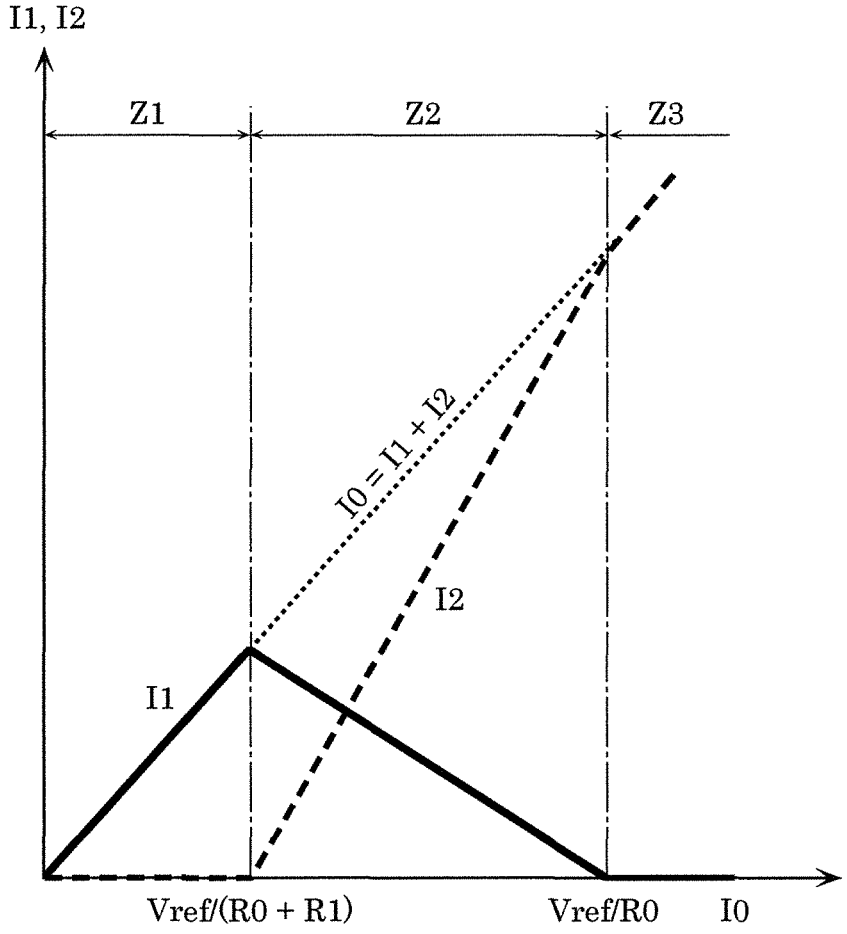
FIG. 2 is a graph illustrating an example of a relationship between a current flowing through a first light-emitting element array, a current flowing through a second light-emitting element array, and a constant current flowing through a third light-emitting element array according to Embodiment 1.

FIG. 2 is a graph illustrating an example of a relationship between current I1 flowing through first light-emitting element array LEDG1, current I2 flowing through second light-emitting element array LEDG2, and constant current I0 flowing through third light-emitting element array LEDG3 according to the present embodiment.

In FIG. 2, the horizontal axis represents the magnitude of constant current I0, and the vertical axis represents the magnitude of current I1 and current I2.

The graph in FIG. 2 shows range Z1 in which current I2 is 0, range Z2 in which both current I1 and current I2 are greater than 0, and range Z3 in which current I1 is 0.

(1) Range Z1

Range Z1 is a range in which the magnitude of constant current I0 is less than or equal to a first threshold. In range Z1, first light-emitting element array LEDG1 and third light-emitting element array LEDG3 are turned on, and second light-emitting element array LEDG2 is turned off.

At this time, since the relationship Vref≥(R0+R1)×I0 is satisfied, the first threshold is represented as Vref/(R0+R1). In range Z1, current adjuster circuit 10A changes the magnitude of current I1 flowing through first light-emitting element array LEDG1 so that current I2 flowing through second light-emitting element array LEDG2 becomes 0.

In range Z1, voltage at the negative-side input terminal of operational amplifier OP1 is sufficiently less than Vref, and thus the output voltage of operational amplifier OP1 is fixed at what is called the high level. With this, transistor Q1 operates in a linear region (i.e., what is called the drain-source resistance value becomes extremely small).

In other words, in range Z1, the sum of the forward voltages of second light-emitting element array LEDG2 is less than the voltage obtained by adding the voltage drop across resistance element Rd1 to the sum of the forward voltages of first light-emitting element array LEDG1, and current I2 of second light-emitting element array LEDG2 is 0.

(2) Range Z2

Range Z2 is a range in which the magnitude of constant current I0 is greater than the first threshold and less than a second threshold. It should be noted that the second threshold is greater than the first threshold. In range Z2, first light-emitting element array LEDG1, second light-emitting element array LEDG2, and third light-emitting element array LEDG3 are all turned on.

At this time, since the relationship (R0+R1)×I0>Vref>R0×I0 is satisfied, the second threshold is represented as Vref/R0. In range Z2, current adjuster circuit 10A controls the magnitude of the current flowing through first light-emitting element array LEDG1 so that current I1 decreases and current I2 increases when constant current I0 increases.

In range Z2, since the difference between voltage V1_ at the negative-side input terminal of operational amplifier OP1 and reference voltage Vref at the positive-side input terminal of operational amplifier OP1 becomes relatively small, the output voltage of operational amplifier OP1 becomes small. As such, transistor Q1 operates in a saturation region (i.e., operates as what is called a variable resistance element).

Specifically, in the case where reference voltage Vref is greater than voltage V1_, the magnitude of the output voltage of operational amplifier OP1 increases when the difference between reference voltage Vref and voltage V1_ increases. Here, voltage V1_ is represented as R1×I1+R0×I0.

When current I1 decreases, the voltage drop across resistance element Rd0 and the voltage drop across resistance element Rd1 decrease, resulting in an increase in the difference between reference voltage Vref and voltage V1_. This causes an increase in the output voltage of operational amplifier OP1, that is, the voltage at the gate terminal of transistor Q1. When the voltage at the gate terminal of transistor Q1 increases, the resistance value of transistor Q1 decreases, thereby increasing current I1.

When current I1 increases, the voltage drop across resistance element Rd0 and the voltage drop across resistance element Rd1 increase, resulting in a decrease in the difference between reference voltage Vref and voltage V1_. This causes a decrease in the output voltage of operational amplifier OP1, that is, the voltage at the gate terminal of transistor Q1. When the voltage at the gate terminal of transistor Q1 decreases, the resistance value of transistor Q1 increases, thereby decreasing current I1.

That is to say, in range Z2, current adjuster circuit 10A adjusts the gate voltage of transistor Q1 so that voltage V1_ becomes equal to reference voltage Vref. In other words, current adjuster circuit 10A adjusts the gate voltage of transistor Q1 so that current I1 flowing through first light-emitting element array LEDG1 has the value shown in Equation 1 below.

$$I1=(Vref-R0\times I0)/R1 \quad \text{(Equation 1)}$$

With this, current adjuster circuit 10A continuously adjusts the current flowing through first light-emitting element array LEDG1.

(3) Range Z3

Range Z3 is a range in which the magnitude of constant current I0 is less than or equal to the second threshold. In range Z3, first light-emitting element array LEDG1 is turned off, and second light-emitting element array LEDG2 and third light-emitting element array LEDG3 are turned on.

At this time, since the relationship R0×I0≥Vref is satisfied, the second threshold is represented as Vref/R0. In range Z3, current adjuster circuit 10A sets the magnitude of the current flowing through first light-emitting element array LEDG1 to 0.

In range Z3, the voltage drop across resistance element Rd0, which is the constant current detector circuit, is greater than or equal to reference voltage Vref. At this time, the voltage at the positive-side input terminal of operational amplifier OP1 (reference voltage Vref) is less than voltage V1_ at the negative-side input terminal of operational amplifier OP1, and thus the output voltage of operational amplifier OP1 is fixed at the low level. With this, transistor Q1 is turned off, and current I1 of first light-emitting element array LEDG1 becomes 0.

Here, a relationship between the color temperature and the illumination intensity of light-emitting device 1A according to the present embodiment will be described with reference to the drawings.

Figure 3:
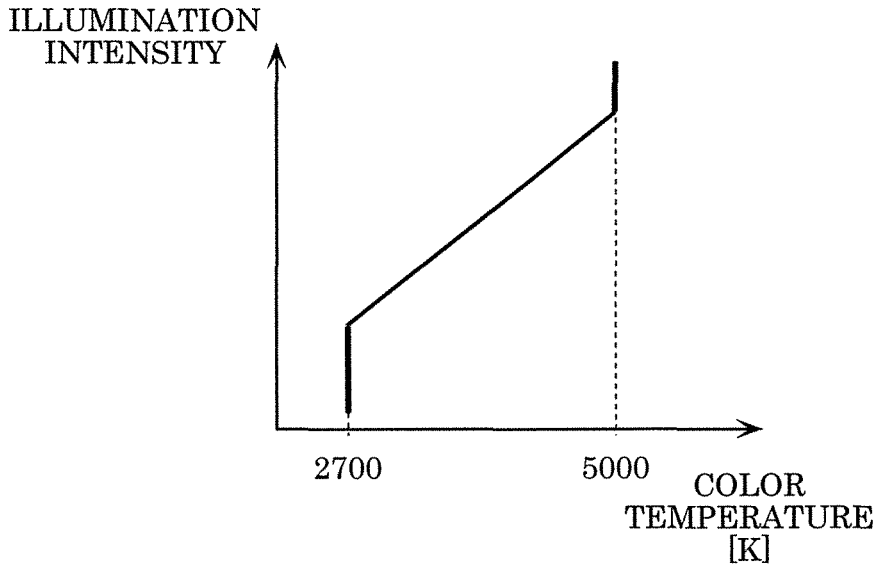
FIG. 3 is a graph illustrating a relationship between the color temperature and the illumination intensity of a light-emitting device according to Embodiment 1.

FIG. 3 is a graph illustrating a relationship between the color temperature and the illumination intensity of light-emitting device 1A according to the present embodiment.

As illustrated in FIG. 3, light-emitting device 1A according to the present embodiment has a color temperature of about 2700 K when the illumination intensity is low; that is, light-emitting device 1A emits light having what is called the light bulb color, which is closer to red. When the illumination intensity is intermediate, the color temperature gradually increases. When the illumination intensity is high, the color temperature is about 5000 K; that is, light-emitting device 1A emits light having what is called the neutral white color, which is closer to a cool color.

Hereinafter, the color temperature of light-emitting device 1A illustrated in FIG. 3 will be described with reference to the drawings.

Figure 4:
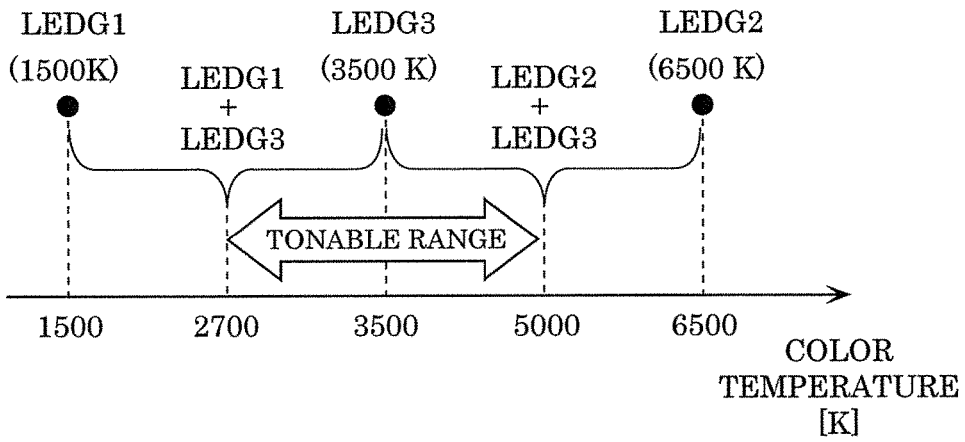
FIG. 4 is a schematic diagram illustrating a relationship between a range of color temperatures in which a light-emitting device according to Embodiment 1 is capable of color toning and the color temperatures of light-emitting element arrays.

FIG. 4 is a schematic diagram illustrating a relationship between the range of color temperatures in which light-emitting device 1A according to the present embodiment is capable of color toning and the color temperatures of the light-emitting element arrays.

When the illumination intensity of light-emitting device 1A is low, first light-emitting element array LEDG1 having a color temperature of 1500 K and third light-emitting element array LEDG3 having a color temperature of 3500 K are turned on. Therefore, as illustrated in FIG. 4, light-emitting device 1A as a whole emits light having a color temperature of about 2700 K, which is about the midpoint between the color temperature 1500 K and the color temperature 3500 K.

On the other hand, when the illumination intensity of light-emitting device 1A is high, second light-emitting element array LEDG2 having a color temperature of 6500 K and third light-emitting element array LEDG3 having a color temperature of 3500 K are turned on. Therefore, as illustrated in FIG. 4, light-emitting device 1A as a whole emits light having a color temperature of about 5000 K, which is about the midpoint between the color temperature 6500 K and the color temperature 3500 K.

When the illumination intensity of light-emitting device 1A is intermediate, first light-emitting element array LEDG1 having a color temperature of 1500 K, second light-emitting element array LEDG2 having a color temperature of 6500 K, and third light-emitting element array LEDG3 having a color temperature of 3500 K are turned on. The ratio of the current flowing through first light-emitting element array LEDG1 and the current flowing through second light-emitting element array LEDG2 changes as illustrated in FIG. 2. Thus, when the illumination intensity of light-emitting device 1A is intermediate, light-emitting device 1A as a whole emits light having a color temperature in a range from 2700 K to 5000 K, and the color temperature increase with an increase in the illumination intensity.

As described above, with light-emitting device 1A according to the present embodiment, it is possible to implement a light-emitting device capable of color toning in a range of color temperatures from 2700 K to 5000 K.

Here, advantageous effects yielded by light-emitting device 1A and luminaire 2A according to the present embodiment will be described while making a comparison with a light-emitting device and a luminaire including the light-emitting device according to a comparative example.

Figure 5:
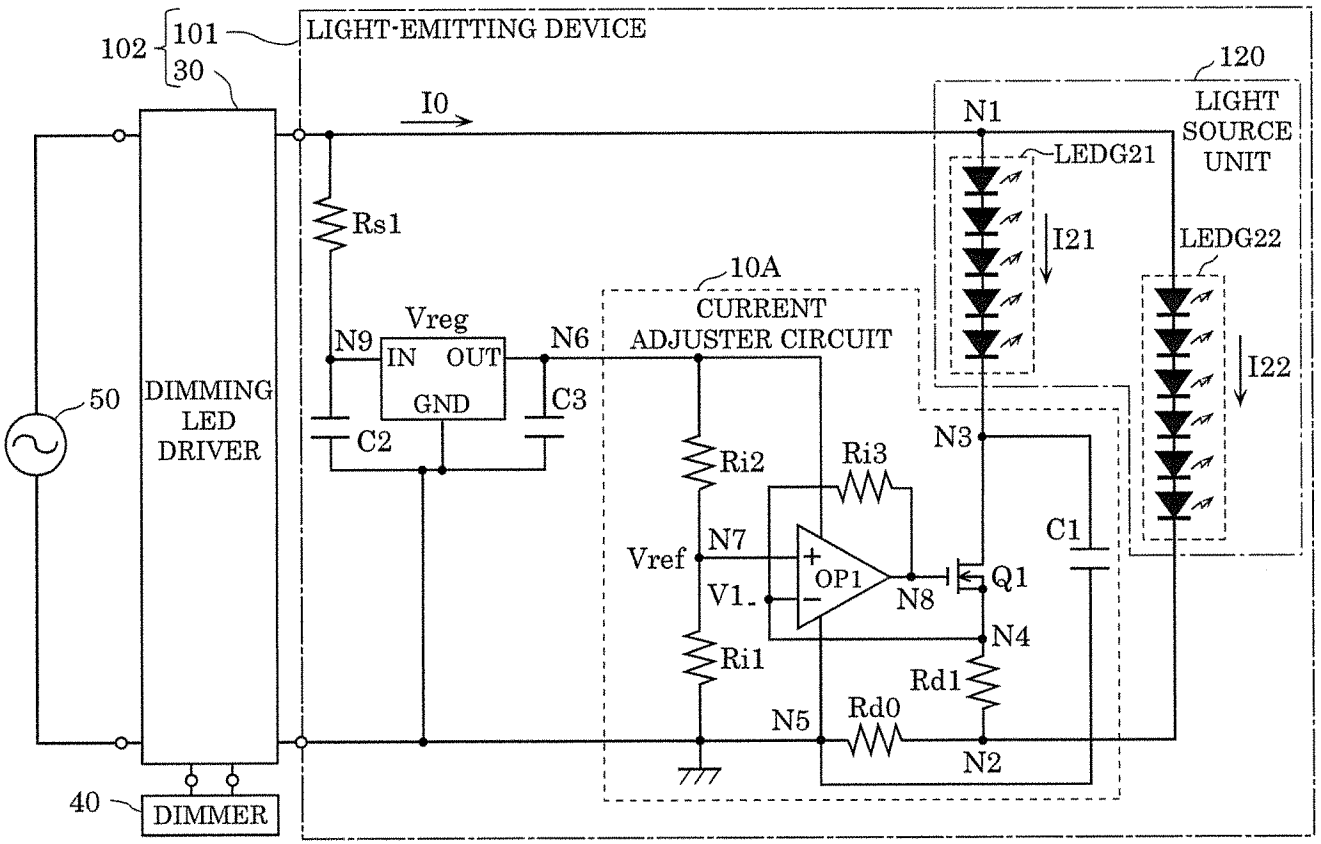
FIG. 5 is a circuit diagram illustrating an example of the circuit configuration of a luminaire according to a comparative example.

FIG. 5 is a circuit diagram illustrating an example of the circuit configuration of luminaire 102 according to a comparative example.

As illustrated in FIG. 5, luminaire 102 according to the comparative example includes light-emitting device 101 and dimming LED driver 30.

As illustrated in FIG. 5, light-emitting device 101 is the same as light-emitting device 1A according to the present embodiment in all structural elements except for light source unit 120.

Light source unit 120 includes first light-emitting element array LEDG21 and second light-emitting element array LEDG22 connected to first light-emitting element array LEDG21 in parallel.

First light-emitting element array LEDG21 includes five LEDs of the same type which are connected in series. The five LEDs included in first light-emitting element array LEDG21 are of the same type as the LEDs included in first light-emitting element array LEDG1 of light source unit 20A according to the present embodiment. It should be noted that the forward voltages of the LEDs included in first light-emitting element array LEDG21 are all the same. A current flowing through first light-emitting element array LEDG21 is referred to as current I21.

Second light-emitting element array LEDG22 includes six LEDs of the same type which are connected in series. The six LEDs included in second light-emitting element array LEDG22 are of the same type as the LEDs included in second light-emitting element array LEDG2 of light source unit 20A according to the present embodiment. It should be noted that the forward voltages of the LEDs included in second light-emitting element array LEDG22 are all the same, and here, the same as the forward voltages of the LEDs included in first light-emitting element array LEDG21. A current flowing through second light-emitting element array LEDG22 is referred to as current I22.

With light-emitting device 101 according to the comparative example, the number of LEDs of first light-emitting element array LEDG21 is less than the number of LEDs of second light-emitting element array LEDG22. That is to say, the sum of the forward voltages of the single or plurality of LEDs that belong to second light-emitting element array LEDG22 is greater than the sum of the forward voltages of the single or plurality of LEDs that belong to first light-emitting element array LEDG21. For this reason, current I21 flows through first light-emitting element array LEDG21 but no current flows through second light-emitting element array LEDG22 when the voltage difference between node N1 and node N2 is greater than the sum of the forward voltages of first light-emitting element array LEDG21 and less than the sum of the forward voltages of second light-emitting element array LEDG22. That is to say, similar to light-emitting device 1A according to the present embodiment, light-emitting device 101 according to the comparative example is also capable of dimming in such a manner that first light-emitting element array LEDG21 is turned on and second light-emitting element array LEDG22 is turned off.

As described above, light source unit 120 according to the comparative example includes first light-emitting element array LEDG21 including five LEDs and second light-emitting element array LEDG22 including six LEDs. That is to say, light source unit 120 includes eleven LEDs in total.

Similar to light-emitting device 1A according to the present embodiment, light-emitting device 101 includes current adjuster circuit 10A. Thus, similar to current I1 and current I2 flowing through first light-emitting element array LEDG1 and second light-emitting element array LEDG2 of light-emitting device 1A, respectively, current I21 and current I22 flowing through first light-emitting element array LEDG21 and second light-emitting element array LEDG22 of light-emitting device 101, respectively, change according to constant current I0 as illustrated in FIG. 2.

Here, a relationship between the color temperature and the dimming level of light-emitting device 1A according to the present embodiment and a relationship between the color temperature and the dimming level of light-emitting device 101 according to the comparative example will be described with reference to the drawings.

Figure 6:
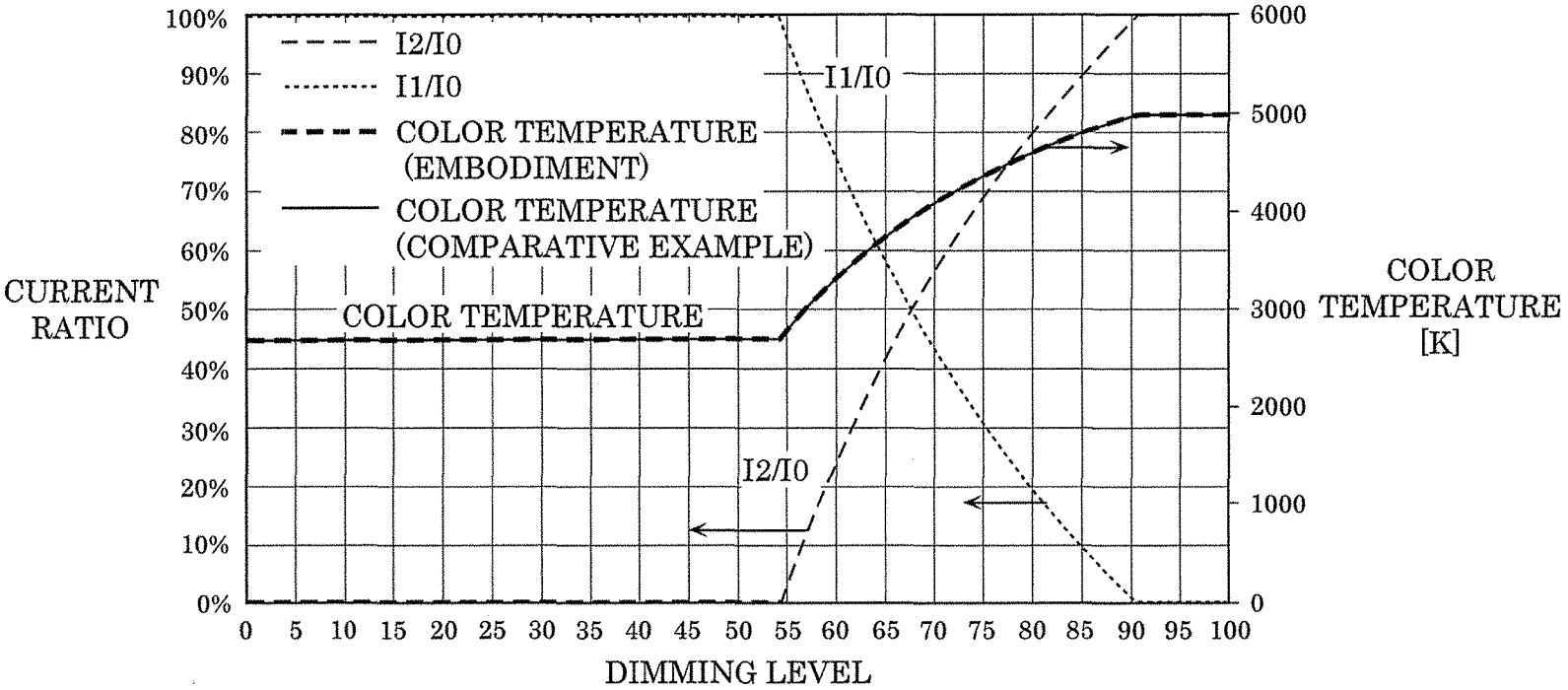
FIG. 6 is a graph illustrating a relationship between the color temperature and the dimming level of a light-emitting device according to Embodiment 1 and a relationship between the color temperature and the dimming level of a light-emitting device according to a comparative example.

FIG. 6 is a graph illustrating a relationship between the color temperature and the dimming level of light-emitting device 1A according to the present embodiment and a relationship between the color temperature and the dimming level of light-emitting device 101 according to the comparative example. The graph in FIG. 6 also shows a relationship between the dimming level and the ratios of the magnitudes of the currents flowing through the light-emitting element arrays of light-emitting device 1A according to the present embodiment to the magnitude of constant current I0.

As illustrated in FIG. 6, with light-emitting device 1A according to the present embodiment, the ratios of the currents flowing through the light-emitting element arrays change according to the dimming level. With this, the color temperature of light-emitting device 1A according to the present embodiment changes in a range from about 2700 K to about 5000 K. As illustrated in FIG. 6, the relationship between the color temperature and the dimming level of light-emitting device 1A according to the present embodiment coincides approximately with that of light-emitting device 101 according to the comparative example.

With light-emitting device 1A according to the present embodiment, the three LEDs of second light-emitting element array LEDG2 and the three LEDs of third light-emitting element array LEDG3, that is, six LEDs in total, are turned on when the dimming level is 100%, for example. In contrast, with light-emitting device 101 according to the comparative example, the six LEDs of second light-emitting element array LEDG22 are turned on when the dimming level is 100%. Therefore, light-emitting device 1A according to the present embodiment can achieve an illumination intensity equivalent to that of light-emitting device 101 according to the comparative example.

As described above, light-emitting device 1A according to the present embodiment can achieve substantially the same dimming and color toning characteristics as light-emitting device 101 according to the comparative example. In addition, as stated above, while light-emitting device 101 according to the comparative example includes a total of eleven LEDs, light-emitting device 1A according to the present embodiment includes a total of eight LEDs. This shows that light-emitting device 1A according to the present embodiment can achieve substantially the same dimming and color toning characteristics as that of light-emitting device 101 according to the comparative example with a less number of LEDs.

[1-3. Advantageous Effects Etc.]

As described above, light-emitting device 1A according to the present embodiment includes: first light-emitting element array LEDG1 including one of a single first light-emitting element or a plurality of first light-emitting elements connected in series, and having a first emission color; and second light-emitting element array LEDG2 including one of a single second light-emitting element or a plurality of second light-emitting elements connected in series, and having a second emission color different from the first emission color. Second light-emitting element array LEDG2 is connected to first light-emitting element array LEDG1 in parallel. Light-emitting device 1A also includes third light-emitting element array LEDG3 including one of a single third light-emitting element or a plurality of third light-emitting elements connected in series, and having a third emission color different from the first emission color and the second emission color. Third light-emitting element array LEDG3 is connected to first light-emitting element array LEDG1 and second light-emitting element array LEDG2 in series.

With this, color toning can be performed by supplying a current to light-emitting device 1A and adjusting the magnitude of the current flowing through first light-emitting element array LEDG1 and the magnitude of the current flowing through second light-emitting element array LEDG2. Moreover, light-emitting device 1A can reduce the number of light-emitting elements used for color toning.

According to light-emitting device 1A, a color temperature of the first emission color is lower than a color temperature of the third emission color, and a color temperature of the second emission color is higher than the color temperature of the third emission color.

Light-emitting device 1A further includes current adjuster circuit 10A which adjusts a current flowing through first light-emitting element array LEDG1.

With this, the illumination intensity of first light-emitting element array LEDG1 can be adjusted.

According to light-emitting device 1A, constant current I0 is supplied to the light-emitting device, and current adjuster circuit 10A adjusts a relationship of the magnitude of the current flowing through first light-emitting element array LEDG1 to the magnitude of constant current I0.

With this, it is possible to adjust the current flowing through first light-emitting element array LEDG1 and the current flowing through second light-emitting element array LEDG2 connected to first light-emitting element array LEDG1 in parallel, thereby allowing light-emitting device 1A to perform color toning.

Light-emitting device 1A further includes a first detector circuit which is connected to first light-emitting element array LEDG1 in series and detects the magnitude of the current flowing through first light-emitting element array LEDG1. Current adjuster circuit 10A adjusts the relationship based on the magnitude of the current as detected by the first detector circuit.

With this, color toning can be performed according to the dimming level in the case where dimming is performed by adjusting the magnitude of constant current I0 supplied to light-emitting device 1A.

According to light-emitting device 1A, current adjuster circuit 10A continuously adjusts the current flowing through first light-emitting element array LEDG1.

With this, light-emitting device 1A can perform color toning with greater flexibility.

According to light-emitting device 1A, current adjuster circuit 10A, first light-emitting element array LEDG1, second light-emitting element array LEDG2, and third light-emitting element array LEDG3 are mounted on the same base.

This allows light-emitting device 1A to be integrally formed and allows the structural elements to be electrically connected to one another.

Furthermore, luminaire 2A according to the present embodiment includes light-emitting device 1A.

With this, luminaire 2A can achieve the same advantageous effect as light-emitting device 1A described above.

Embodiment 2

Hereinafter, a light-emitting device and a luminaire including the light-emitting device according to Embodiment 2 will be described.

While Embodiment 1 has described light-emitting device 1A which can continuously change the color temperature, the present embodiment will describe a light-emitting device and a luminaire which can discretely change the color temperature. Hereinafter, the light-emitting device and the luminaire according to the present embodiment will be described, focusing on differences from light-emitting device 1A and luminaire 2A according to Embodiment 1.

[2-1. Luminaire Configuration]

Hereinafter, the configurations of the light-emitting device and the luminaire including the light-emitting device according to the present embodiment will be described with reference to the drawings.

Figure 7:
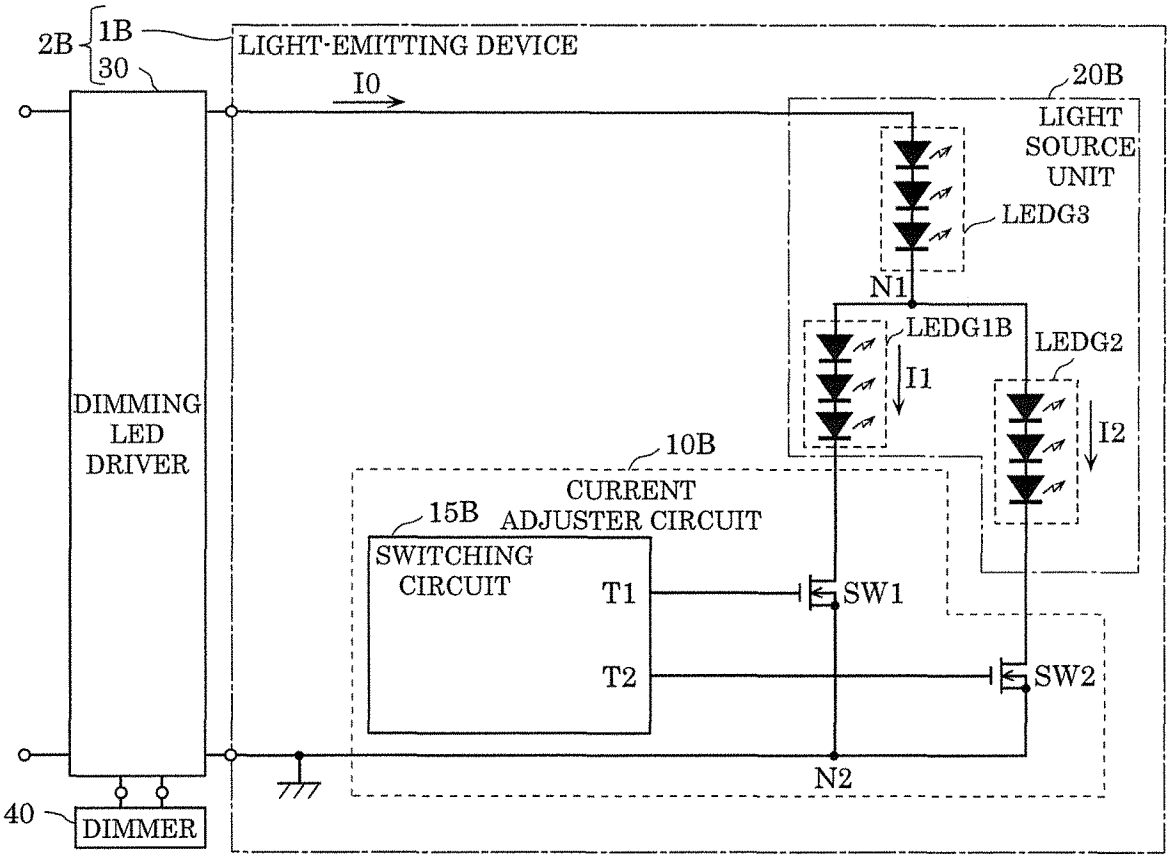
FIG. 7 is a circuit diagram illustrating an example of the circuit configuration of a luminaire according to Embodiment 2.

FIG. 7 is a circuit diagram illustrating an example of the circuit configuration of luminaire 2B according to the present embodiment.

Luminaire 2B has dimming and color toning functions and includes dimming LED driver 30 and light-emitting device 1B as illustrated in FIG. 7. The dimming level of luminaire 2B is determined by dimmer 40.

Light-emitting device 1B includes light source unit 20B and current adjuster circuit 10B. Light-emitting device 1B is different from light-emitting device 1A according to Embodiment 1 in configurations of light source unit 20B and current adjuster circuit 10B.

Light source unit 20B includes first light-emitting element array LEDG1B, second light-emitting element array LEDG2 connected to first light-emitting element array LEDG1B in parallel, and third light-emitting element array LEDG3 connected to first light-emitting element array LEDG1B and second light-emitting element array LEDG2 in series. Light source unit 20B is the same as light source unit 20A according to Embodiment 1 in all aspects except for the number of LEDs included in first light-emitting element array LEDG1B. First light-emitting element array LEDG1B includes three LEDs. In the present embodiment, no current adjustment is performed which makes use of the difference between the sum of forward voltages of first light-emitting element array LEDG1B and the sum of forward voltages of second light-emitting element array LEDG2. Therefore, the relationship between the sum of the forward voltages of first light-emitting element array LEDG1B and the sum of the forward voltages of second light-emitting element array LEDG2 is not limited.

Current adjuster circuit 10B adjusts a current flowing through first light-emitting element array LEDG1B and a current flowing through second light-emitting element array LEDG2, and includes switching circuit 15B and switching elements SW1 and SW2. In the present embodiment, current adjuster circuit 10B adjusts the current flowing through first light-emitting element array LEDG1B and the current flowing through second light-emitting element array LEDG2 so that a current flows through only one of first light-emitting element array LEDG1B and second light-emitting element array LEDG2 at a given time.

Switching circuit 15B controls the current flowing through first light-emitting element array LEDG1B and the current flowing through second light-emitting element array LEDG2. In the present embodiment, switching circuit 15B turns switching elements SW1 and SW2 on and off by outputting signals to switching elements SW1 and SW2. Switching circuit 15B has output terminals T1 and T2. Output from output terminal T1 is a high-level or low-level signal for controlling switching element SW1, whereas output from terminal T2 is a high-level or low-level signal for controlling switching element SW2. With this, switching circuit 15B turns on one of switching elements SW1 and SW2, and turns off the other. With switching circuit 15B operating in the above-described manner, light-emitting device 1B according to the present embodiment can turn on only third light-emitting element array LEDG3 and one of first light-emitting element array LEDG1B and second light-emitting element array LEDG2.

Switching circuit 15B outputs signals to switching elements SW1 and SW2 based on an external operation. The signals to be output to switching elements SW1 and SW2 may be determined by a switch provided to luminaire 2B, for example. Furthermore, the signals to be output to switching elements SW1 and SW2 may be determined based on an operation on an external switch which turns luminaire 2B on and off. For example, the signals to be output to switching elements SW1 and SW2 may be changed based on an operation of turning the external switch on, off, and on within a predetermined short period of time (within about three seconds, for example). That is to say, the signals to be output to switching elements SW1 and SW2 may be changed when it is detected, by switching circuit 15B detecting a current supplied from dimming LED driver 30, that the external switch is turned on, off, and on within the predetermined period of time.

Switching element SW1 selectively provides electrical conduction and isolation between first light-emitting element array LEDG1B and node N2. Switching element SW1 selectively provides electrical conduction and isolation between first light-emitting element array LEDG1B and node N2 based on the signal from switching circuit 15B. In the present embodiment, switching element SW1 is an MOSFET, and has a gate terminal connected to output terminal T1 of switching circuit 15B, a drain terminal connected to the cathode terminal of first light-emitting element array LEDG1B, and a source terminal connected to node N2. When the high-level signal is applied to the gate terminal of switching element SW1 from switching circuit 15B, the drain terminal and the source terminal of switching element SW1 are brought into electrical conduction, allowing a current to flow through first light-emitting element array LEDG1B. On the other hand, when the low-level signal is applied to the gate terminal of switching element SW1 from switching circuit 15B, the drain terminal and the source terminal of switching element SW1 are substantially isolated from each other, not allowing a current to flow through first light-emitting element array LEDG1B.

Switching element SW2 selectively provides electrical conduction and isolation between second light-emitting element array LEDG2 and node N2. Switching element SW2 selectively provides electrical conduction and isolation between second light-emitting element array LEDG2 and node N2 based on the signal from switching circuit 15B. In the present embodiment, switching element SW2 is an MOSFET, and has a gate terminal connected to output terminal T2 of switching circuit 15B, a drain terminal connected to the cathode terminal of second light-emitting element array LEDG2, and a source terminal connected to node N2. The operation of switching element SW2 is the same as the operation of switching element SW1 described above, and thus the description thereof is omitted here.

It should be noted that in the present embodiment, a constant current supply with no dimming function may be used in place of dimming LED driver 30.

[2-2. Operation]

Hereinafter, an operation of light-emitting device 1B according to the present embodiment will be described.

With light-emitting device 1B according to the present embodiment, only one of switching elements SW1 and SW2 is turned on as described earlier. Therefore, light-emitting device 1B can be switched between a state in which first light-emitting element array LEDG1B and third light-emitting element array LEDG3 are turned on and a state in which second light-emitting element array LEDG2 and third light-emitting element array LEDG3 are turned on. Here, the color temperatures that light-emitting device 1B can achieve through color toning will be described with reference to the drawings.

Figure 8:
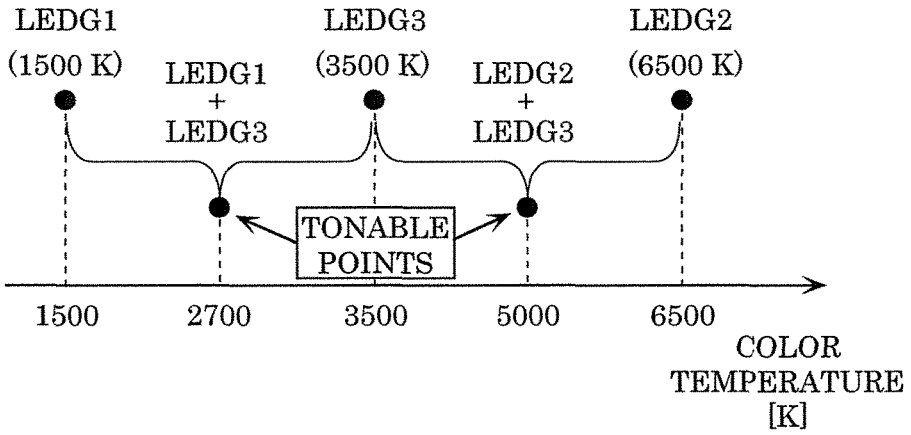
FIG. 8 is a schematic diagram illustrating a relationship between color temperatures that a light-emitting device according to Embodiment 2 can achieve through color toning and the color temperatures of light-emitting element arrays.

FIG. 8 is a schematic diagram illustrating a relationship between the color temperatures that light-emitting device 1B according to the present embodiment can achieve through color toning and the color temperatures of the light-emitting element arrays.

As illustrated in FIG. 8, when first light-emitting element array LEDG1B having a color temperature of 1500 K and third light-emitting element array LEDG3 having a color temperature of 3500 K are turned on, light-emitting device 1B as a whole emits light at a color temperature of 2700 K. On the other hand, when second light-emitting element array LEDG2 having a color temperature of 6500 K and third light-emitting element array LEDG3 having a color temperature of 3500 K are turned on, light-emitting device 1B as a whole emits light at a color temperature of 5000 K. That is to say, light-emitting device 1B can discretely change the color temperature at two points, i.e., the color temperature of 2700 K and the color temperature of 5000 K.

[2-3. Advantageous Effects Etc.]

As described above, light-emitting device 1B according to the present embodiment includes: first light-emitting element array LEDG1 including one of a single first light-emitting element or a plurality of first light-emitting elements connected in series, and having a first emission color; and second light-emitting element array LEDG2 including one of a single second light-emitting element or a plurality of second light-emitting elements connected in series, and having a second emission color different from the first emission color. Second light-emitting element array LEDG2 is connected to first light-emitting element array LEDG1 in parallel. Light-emitting device 1B also includes third light-emitting element array LEDG3 including one of a single third light-emitting element or a plurality of third light-emitting elements connected in series, and having a third emission color different from the first emission color and the second emission color. Third light-emitting element array LEDG3 is connected to first light-emitting element array LEDG1 and second light-emitting element array LEDG2 in series.

With this, color toning can be performed by supplying a current to light-emitting device 1B and adjusting the magnitude of the current flowing through first light-emitting element array LEDG1B and the magnitude of the current flowing through second light-emitting element array LEDG2. Moreover, light-emitting device 1B can reduce the number of light-emitting elements used for color toning.

According to light-emitting device 1B, current adjuster circuit 10B discretely adjusts the current flowing through first light-emitting element array LEDG1.

With this, light-emitting device 1B can discretely change the emission color.

According to light-emitting device 1B, current adjuster circuit 10B also adjusts a current flowing through second light-emitting element array LEDG2.

With this, the current flowing through each of the light-emitting element arrays can be easily adjusted.

According to light-emitting device 1B, current adjuster circuit 10B adjusts the current flowing through first light-emitting element array LEDG1 and the current flowing through second light-emitting element array LEDG2 so that a current flows through only one of first light-emitting element array LEDG1 and second light-emitting element array LEDG2 at a given time.

With this, light-emitting device 1B can perform discrete color toning.

Embodiment 3

Hereinafter, a light-emitting device and a luminaire including the light-emitting device according to Embodiment 3 will be described.

While Embodiment 2 has described light-emitting device 1B which changes the color temperature using two switching elements, the present embodiment will describe a light-emitting device and a luminaire which can change the color temperature using one switching element. Hereinafter, the light-emitting device and the luminaire according to the present embodiment will be described, focusing on differences from light-emitting device 1B and luminaire 2B according to Embodiment 2.

[3-1. Luminaire Configuration]

Hereinafter, the configurations of the light-emitting device and the luminaire according to the present embodiment will be described with reference to the drawings.

Figure 9:
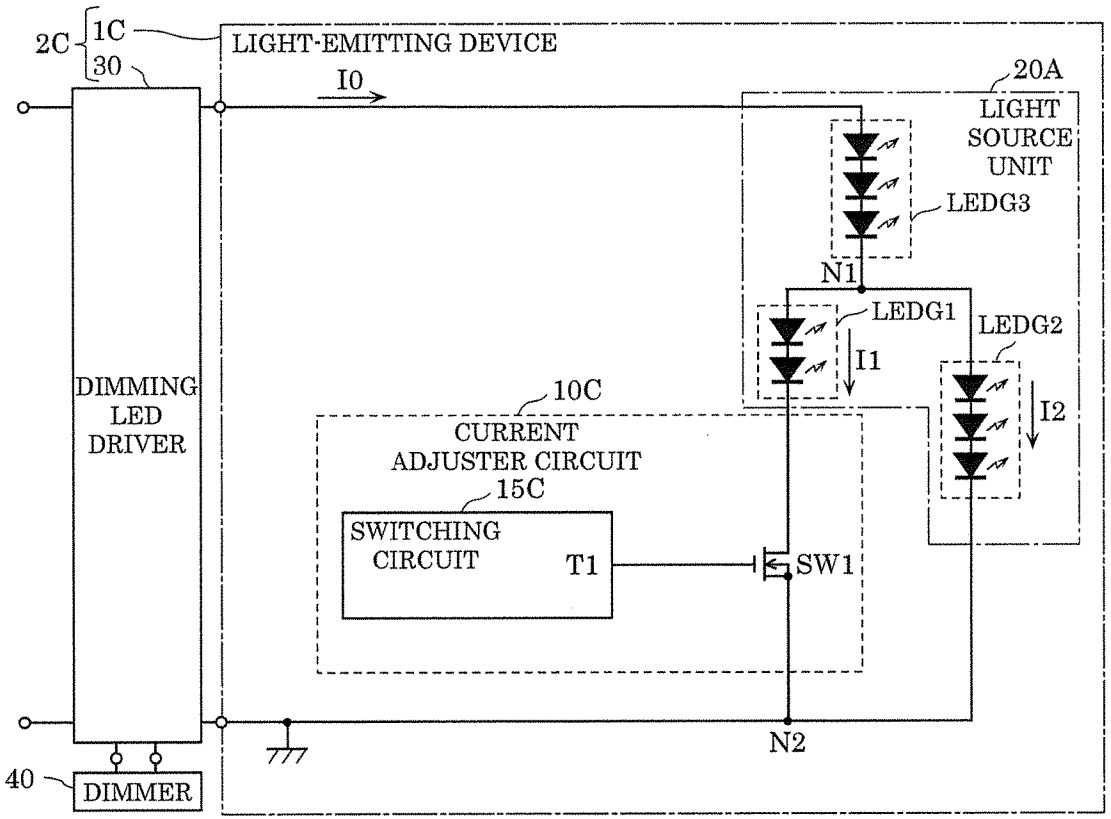
FIG. 9 is a circuit diagram illustrating an example of the circuit configuration of a luminaire according to Embodiment 3.

FIG. 9 is a circuit diagram illustrating an example of the circuit configuration of luminaire 2C according to the present embodiment.

As illustrated in FIG. 9, luminaire 2C has dimming and color toning functions and includes dimming LED driver 30 and light-emitting device 1C. The dimming level of luminaire 2C is determined by dimmer 40.

Light-emitting device 1C includes light source unit 20A and current adjuster circuit 10C. Light-emitting device 1C is different from light-emitting device 1B according to Embodiment 2 in configurations of light source unit 20A and current adjuster circuit 10C.

Light source unit 20A has the same configuration as light source unit 20A according to Embodiment 1. That is to say, the sum of the forward voltages of first light-emitting element array LEDG1 is less than the sum of the forward voltages of second light-emitting element array LEDG2.

Current adjuster circuit 10C adjusts a current flowing through first light-emitting element array LEDG1 and a current flowing through second light-emitting element array LEDG2, and includes switching circuit 15C and switching element SW1.

Switching circuit 15C controls the current flowing through first light-emitting element array LEDG1. In the present embodiment, switching circuit 15C turns switching element SW1 on and off by outputting a signal to switching element SW1. Switching circuit 15C has output terminal T1. Output from output terminal T1 is a high-level or low-level signal for controlling switching element SW1. With this, switching circuit 15C turns switching element SW1 on or off. As described above, with light-emitting device 1C according to the present embodiment, one of first light-emitting element array LEDG1 and second light-emitting element array LEDG2 can be selectively turned on, by making use of the operation of switching circuit 15C and the fact that the sum of the forward voltages of first light-emitting element array LEDG1 is less than the sum of the forward voltages of second light-emitting element array LEDG2. Details of the operation of light-emitting device 1C will be described later.

Switching circuit 15C outputs a signal to switching element SW1 based on an external operation. The signal to be output to switching element SW1 may be determined by a switch provided to luminaire 2C, for example. Furthermore, the signal to be output to switching element SW1 may be determined based on an operation on an external switch which turns luminaire 2C on and off.

Switching element SW1 turns on and off the current flowing through first light-emitting element array LEDG1. The configuration of switching element SW1 is the same as that of switching element SW1 according to Embodiment 2, and thus the description thereof is omitted here.

It should be noted that in the present embodiment, a constant current supply with no dimming function may be used in place of dimming LED driver 30.

[3-2. Operation]

Hereinafter, an operation of light-emitting device 1C according to the present embodiment will be described.

With light-emitting device 1C according to the present embodiment, switching element SW1 is turned on or off as described earlier.

When switching element SW1 is turned off, constant current I0 output from dimming LED driver 30 flows through third light-emitting element array LEDG3 and second light-emitting element array LEDG2.

On the other hand, when switching element SW1 is turned on, it is possible to pass constant current I0 from dimming LED driver 30 through third light-emitting element array LEDG3 and first light-emitting element array LEDG1 only, by limiting constant current I0 to a predetermined range. That is to say, the voltage to be applied to first light-emitting element array LEDG1 is limited to below the sum of the forward voltages of second light-emitting element array LEDG2 by setting constant current I0 below a predetermined value. This suppresses a flow of current through second light-emitting element array LEDG2.

As described above, even in the present embodiment, discrete color toning can be performed in a similar manner to light-emitting device 1B according to Embodiment 2. Moreover, since the number of switching elements can be reduced, it is possible to reduce the size and cost of light-emitting device 1C.

[3-3. Advantageous Effects Etc.]

As described above, light-emitting device 1C according to the present embodiment includes: first light-emitting element array LEDG1 including one of a single first light-emitting element or a plurality of first light-emitting elements connected in series, and having a first emission color; and second light-emitting element array LEDG2 including one of a single second light-emitting element or a plurality of second light-emitting elements connected in series, and having a second emission color different from the first emission color. Second light-emitting element array LEDG2 is connected to first light-emitting element array LEDG1 in parallel. Light-emitting device 1C also includes third light-emitting element array LEDG3 including one of a single third light-emitting element or a plurality of third light-emitting elements connected in series, and having a third emission color different from the first emission color and the second emission color. Third light-emitting element array LEDG3 is connected to first light-emitting element array LEDG1 and second light-emitting element array LEDG2 in series.

With this, color toning can be performed by supplying a current to light-emitting device 1C and adjusting the magnitude of the current flowing through first light-emitting element array LEDG1. Moreover, light-emitting device 1C can reduce the number of light-emitting elements used for color toning.

According to light-emitting device 1C, current adjuster circuit 10C discretely adjusts the current flowing through first light-emitting element array LEDG1.

With this, light-emitting device 1C can discretely change the emission color.

Embodiment 4

Hereinafter, a light-emitting device and a luminaire including the light-emitting device according to Embodiment 4 will be described.

While Embodiment 1 has described the configuration in which color toning is performed according to the magnitude of constant current I0 flowing through light-emitting device 1A, the present embodiment will describe a configuration in which the light-emitting device itself can adjust the current flowing through the light-emitting device. Hereinafter, the light-emitting device and the luminaire according to the present embodiment will be described, focusing on differences from light-emitting device 1A and luminaire 2A according to Embodiment 1.

[4-1. Luminaire Configuration]

Hereinafter, the configurations of the light-emitting device and the luminaire according to the present embodiment will be described with reference to the drawings.

Figure 10:
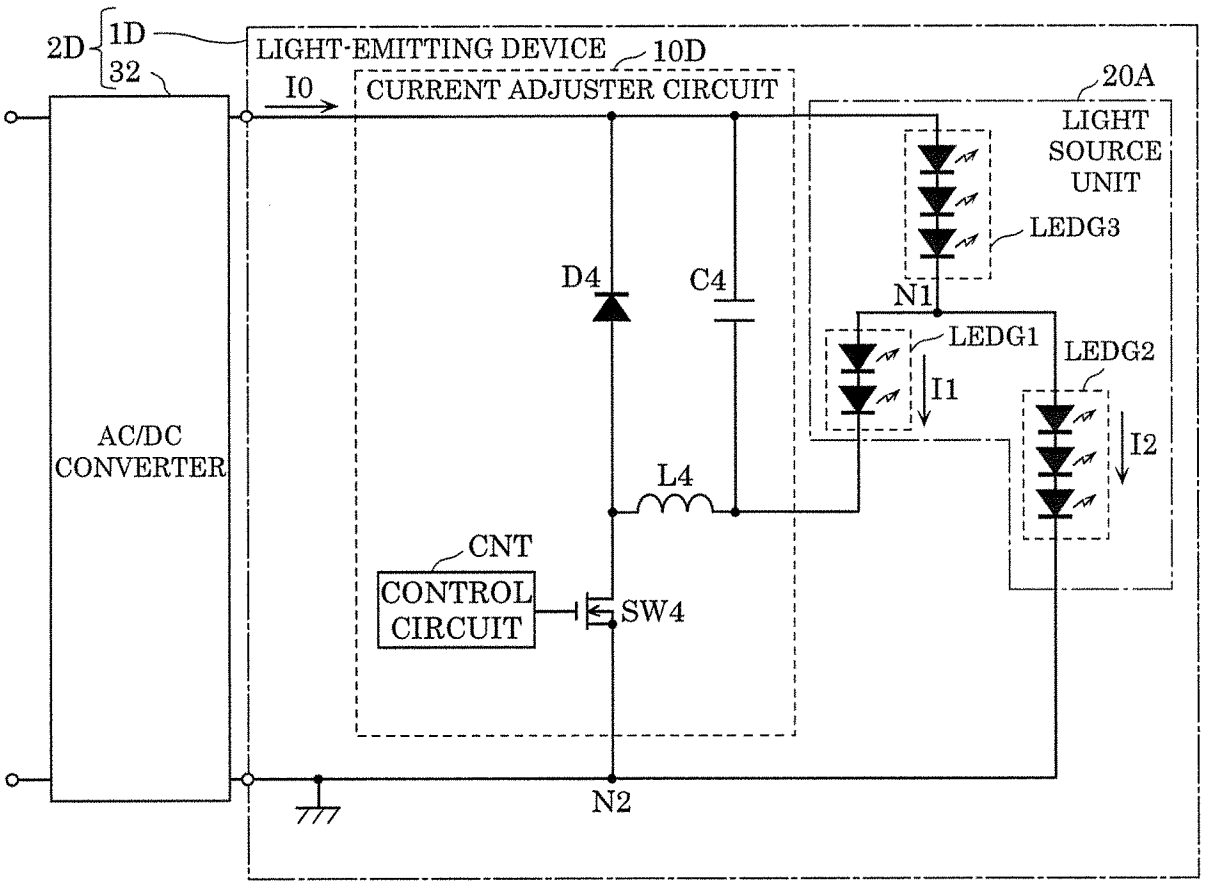
FIG. 10 is a circuit diagram illustrating an example of the circuit configuration of a luminaire according to Embodiment 4.

FIG. 10 is a circuit diagram illustrating an example of the circuit configuration of luminaire 2D according to the present embodiment.

As illustrated in FIG. 10, luminaire 2D has dimming and color toning functions and includes AC/DC converter 32 and light-emitting device 1D.

AC/DC converter 32 converts AC power input from outside to DC power. Details of AC/DC converter 32 are well known to a person with an ordinary skill in the art, and are thus omitted here.

Light-emitting device 1D includes light source unit 20A and current adjuster circuit 10D. Light-emitting device 1D is different from light-emitting device 1A according to Embodiment 1 in configuration of current adjuster circuit 10D and in that DC power is supplied from AC/DC converter 32. It should be noted that although light-emitting device 1D includes the same light source unit 20A as that of light-emitting device 1A according to Embodiment 1, the configuration of light source unit 20A is not limited to this. For example, light source unit 20B according to Embodiment 2 may be used.

Current adjuster circuit 10D adjusts the current flowing through first light-emitting element array LEDG1 and the current flowing through second light-emitting element array LEDG2. In the present embodiment, current adjuster circuit 10D is a step-down converter. Current adjuster circuit 10D includes diode D4, capacitor C4, inductor L4, switching element SW4, and control circuit CNT. Current adjuster circuit 10D can adjust the current flowing through first light-emitting element array LEDG1 by control circuit CNT applying a signal for repeatedly turning switching element SW4 on and off. At least one of a dimming signal and a color toning signal is applied to control circuit CNT from outside, and switching element SW4 is controlled based on the signal. With this, the magnitude of the current flowing through first light-emitting element array LEDG1 can be adjusted. This means that light-emitting device 1D can perform dimming.

It should be noted that current adjuster circuit 10D may be a DC/DC converter different from the step-down converter.

[4-2. Advantageous Effects Etc.]

As described above, light-emitting device 1D according to the present embodiment includes: first light-emitting element array LEDG1 including one of a single first light-emitting element or a plurality of first light-emitting elements connected in series, and having a first emission color; and second light-emitting element array LEDG2 including one of a single second light-emitting element or a plurality of second light-emitting elements connected in series, and having a second emission color different from the first emission color. Second light-emitting element array LEDG2 is connected to first light-emitting element array LEDG1 in parallel. Light-emitting device 1D also includes third light-emitting element array LEDG3 including one of a single third light-emitting element or a plurality of third light-emitting elements connected in series, and having a third emission color different from the first emission color and the second emission color. Third light-emitting element array LEDG3 is connected to first light-emitting element array LEDG1 and second light-emitting element array LEDG2 in series.

With this, color toning can be performed by supplying a current to light-emitting device 1D and adjusting the magnitude of the current flowing through first light-emitting element array LEDG1. Moreover, light-emitting device 1D can reduce the number of light-emitting elements used for color toning.

Light-emitting device 1D according to the present embodiment is supplied with DC power from AC/DC converter 32, and current adjuster circuit 10D is a DC/DC converter.

With this, first light-emitting element array LEDG1 of light source unit 20A can be supplied with a desired current.

[4-3. Variation]

Hereinafter, a light-emitting device according to a variation of the present embodiment will be described.

With light-emitting device 1D according to the present embodiment, current adjuster circuit 10D is provided only on a side where first light-emitting element array LEDG1 is disposed; however, current adjuster circuit 10D may also be provided on a side where second light-emitting element array LEDG2 is disposed. Such a configuration will be described with reference to the drawings.

Figure 11:
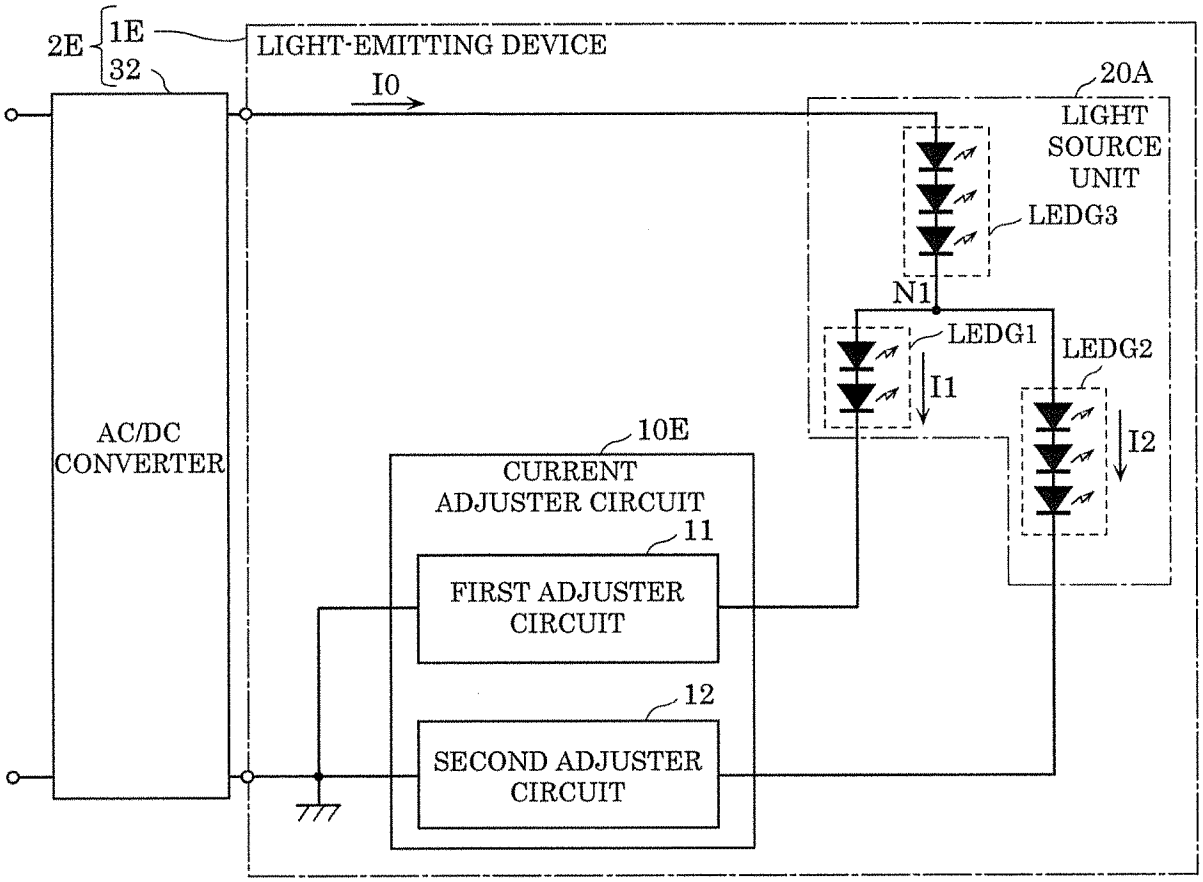
FIG. 11 is a circuit diagram illustrating an example of the circuit configuration of a luminaire according to a variation of Embodiment 4.

FIG. 11 is a circuit diagram illustrating an example of the circuit configuration of luminaire 2E according to the variation of the present embodiment.

As illustrated in FIG. 11, luminaire 2E includes light-emitting device 1E and AC/DC converter 32.

Light-emitting device 1E includes current adjuster circuit 10E and light source unit 20A.

Current adjuster circuit 10E includes first adjuster circuit 11 and second adjuster circuit 12.

First adjuster circuit 11 and second adjuster circuit 12 adjust the current flowing through first light-emitting element array LEDG1 and the current flowing through second light-emitting element array LEDG2, respectively. In the present variation, first adjusting circuit 11 and second adjusting circuit 12 are each the same step-down converter as that of current adjuster circuit 10D. With this, each of first light-emitting element array LEDG1 and second light-emitting element array LEDG2 can be supplied with a desired current. It should be noted that each of first adjusting circuit 11 and second adjusting circuit 12 may be a DC/DC converter different from the step-down converter.

According to the present variation, the above-described configuration allows each of first light-emitting element array LEDG1 and second light-emitting element array LEDG2 to be supplied with a desired current.

Embodiment 5

As Embodiment 5, an example of application of the luminaire according to each of the above embodiments will be described with reference to the drawings.

Figure 12:
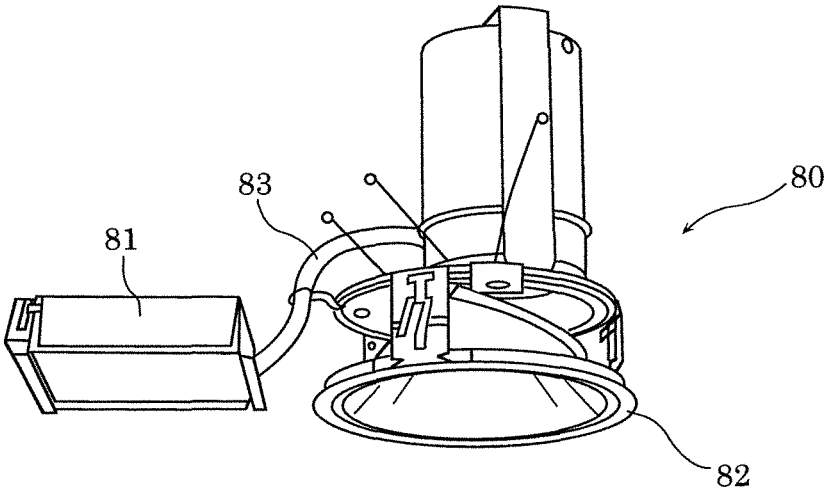
FIG. 12 is a perspective view illustrating an example of the exterior appearance of a luminaire according to Embodiment 5.
Figure 13:
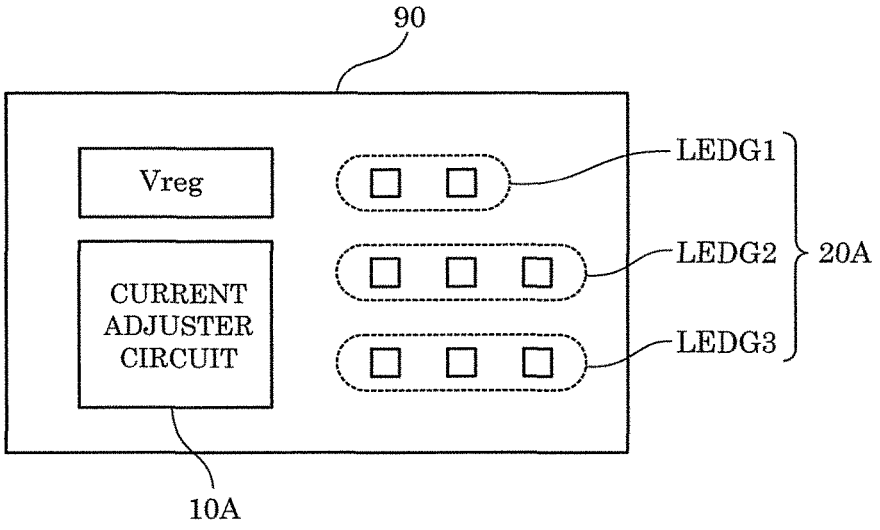
FIG. 13 is a schematic diagram illustrating a base on which structural elements of a luminaire according to Embodiment 5 are mounted.

FIG. 12 is a perspective view illustrating an example of the exterior appearance of luminaire 80 according to the present embodiment. Luminaire 80 illustrated in FIG. 12 is a downlight, and includes circuit box 81, lamp body 82, and wire 83. Circuit box 81 houses circuits included in luminaire 80, such as dimming LED driver 30 and light-emitting device 1A. Lamp body 82 houses light source unit 20A or light source unit 20B. Wire 83 connects the circuits and the light source unit included in luminaire 80. It should be noted that, as illustrated in FIG. 13, the circuits included in luminaire 80 such as current adjuster circuit 10A and Vreg may be mounted on the same base 90 as light source unit 20A, to be housed in lamp body 82. This allows light-emitting device 1A to be integrally formed and allows the structural elements to be electrically connected to one another.

It should be noted that the example of application of the luminaire according to each of the above embodiments is not limited to a downlight. The luminaire according to each of the above embodiments can be applied to any luminaire that performs dimming and color toning.

[Others]

Hereinbefore, the present disclosure has been described based on embodiments; however, the present disclosure is not limited to each of the above embodiments.

For example, although each of the above embodiments has illustrated that the color temperature of the first emission color is lower than the color temperature of the third emission color and that the color temperature of the second emission color is higher than the color temperature of the third emission color, the color temperatures of these emission colors are not limited to such a relationship. For example, the color temperature of the first emission color may be lower than the color temperature of the second emission color, and the color temperature of the second emission color may be lower than the color temperature of the third emission color.

Furthermore, although each of the above embodiments has illustrated the example case in which the first light-emitting elements and the second light-emitting elements are LEDs, the present disclosure is not limited to this example. The first light-emitting elements and the second light-emitting elements may be other light-emitting elements such as organic EL elements.

Furthermore, although each of the above embodiments has illustrated the example case in which the magnitudes of the forward voltages of the LEDs, which are examples of the first light-emitting elements and the second light-emitting elements, are all the same (of the same type), the present disclosure is not limited to this example.

Moreover, although Embodiment 1 has illustrated that the number of LEDs included in first light-emitting element array LEDG1 is two, the number of LEDs included in second light-emitting element array LEDG2 is three, and the number of LEDs included in third light-emitting element array LEDG3 is three, the present disclosure is not limited to these numbers. The number of LEDs included in each light-emitting element array according to other embodiments is likewise not limited to the number described in the embodiments above.

In addition, although each light-emitting element array in each of the above embodiments includes light-emitting elements connected in series, each light-emitting element array may have a configuration in which a plurality of series-connected light-emitting element arrays are connected in parallel.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A light-emitting device, comprising:

a first light-emitting element array including one of a single first light-emitting element or a plurality of first light-emitting elements connected in series, and having a first emission color;

a second light-emitting element array including one of a single second light-emitting element or a plurality of second light-emitting elements connected in series, and having a second emission color different from the first emission color, the second light-emitting element array being connected to the first light-emitting element array in parallel;

a third light-emitting element array including one of a single third light-emitting element or a plurality of third light-emitting elements connected in series, and having a third emission color different from the first emission color and the second emission color, the third light-emitting element array being connected to the first light-emitting element array and the second light-emitting element array in series; and a current adjuster circuit which adjusts a current flowing through the first light-emitting element array, wherein a color temperature of the first emission color is lower than a color temperature of the third emission color, and a color temperature of the second emission color is higher than the color temperature of the third emission color, a constant current is supplied to the light-emitting device, and the current adjuster circuit changes a relationship of a magnitude of the current flowing through the first light-emitting element array to a magnitude of the constant current according to the magnitude of the constant current.

2. The light-emitting device according to claim 1, further comprising a first detector circuit which is connected to the first light-emitting element array in series and detects the magnitude of the current flowing through the first light-emitting element array, wherein the current adjuster circuit adjusts the relationship based on the magnitude of the current as detected by the first detector circuit.

3. The light-emitting device according to claim 1, wherein the current adjuster circuit discretely adjusts the current flowing through the first light-emitting element array.

4. The light-emitting device according to claim 1, wherein the current adjuster circuit continuously adjusts the current flowing through the first light-emitting element array.

5. The light-emitting device according to claim 1, wherein the current adjuster circuit also adjusts a current flowing through the second light-emitting element array.

6. The light-emitting device according to claim 5, wherein the current adjuster circuit adjusts the current flowing through the first light-emitting element array and the current flowing through the second light-emitting element array so that a current flows through only one of the first light-emitting element array and the second light-emitting element array at a given time.

7. The light-emitting device according to claim 1, wherein the current adjuster circuit, the first light-emitting element array, the second light-emitting element array, and the third light-emitting element array are mounted on a same base.

8. The light-emitting device according to claim 1, wherein a color is adjustable over a range of color temperatures from 2700 K to 5000 K, inclusive.

9. A luminaire, comprising:

a first light-emitting element array including one of a single first light-emitting element or a plurality of first light-emitting elements connected in series, and having a first emission color;

a second light-emitting element array including one of a single second light-emitting element or a plurality of second light-emitting elements connected in series, and having a second emission color different from the first emission color, the second light-emitting element array being connected to the first light-emitting element array in parallel;

a third light-emitting element array including one of a single third light-emitting element or a plurality of third light-emitting elements connected in series, and having a third emission color different from the first emission color and the second emission color, the third light-emitting element array being connected to the first light-emitting element array and the second light-emitting element array in series;

a current supply which provides a current to the series-connected third-lighting emitting element array and first light-emitting element array and the second light-emitting element array, a current adjuster circuit which adjusts a current flowing through the first light-emitting element array, wherein a color temperature of the first emission color is lower than a color temperature of the third emission color, and a color temperature of the second emission color is higher than the color temperature of the third emission color, the current supply supplies a constant current to the light-emitting device, and the current adjuster circuit adjusts a relationship of a magnitude of the current flowing through the first light-emitting element array to a magnitude of the constant current.

10. The luminaire according to claim 9, wherein the current adjuster circuit also adjusts a current flowing through the second light-emitting element array.

11. The luminaire according to claim 10, wherein the current adjuster circuit adjusts the current flowing through the first light-emitting element array and the current flowing through the second light-emitting element array so that a current flows through only one of the first light-emitting element array and the second light-emitting element array at a given time.

12. The luminaire according to claim 9, wherein a color is adjustable over a range of color temperatures from 2700 K to 5000 K, inclusive.

13. A method of providing color toning in a lighting device comprising:

a first light-emitting element array including one of a single first light-emitting element or a plurality of first light-emitting elements connected in series, and having a first emission color;

a second light-emitting element array including one of a single second light-emitting element or a plurality of second light-emitting elements connected in series, and having a second emission color different from the first emission color, the second light-emitting element array being connected to the first light-emitting element array in parallel; and a third light-emitting element array including one of a single third light-emitting element or a plurality of third light-emitting elements connected in series, and having a third emission color different from the first emission color and the second emission color, the third light-emitting element array being connected to the first light-emitting element array and the second light-emitting element array in series, the method comprising the steps of:

providing a current to the third-lighting emitting element array connected in series with the first light-emitting element array and the second light-emitting element array; and controlling a current flowing through the first light-emitting element array, wherein a color temperature of the first emission color is lower than a color temperature of the third emission color, and a color temperature of the second emission color is higher than the color temperature of the third emission color, the current provided to the third-lighting emitting element array connected in series with the first light-emitting element array and the second light-emitting element array is a constant current; and the step of controlling comprises adjusting a relationship of a magnitude of the current flowing through the first light-emitting element array to a magnitude of the constant current.

14. The method according to claim 13, wherein the step of controlling comprises discretely adjusting the current flowing through the first light-emitting element array.

15. The method according to claim 13, wherein the step of controlling comprises continuously adjusting the current flowing through the first light-emitting element array.

* * * * *